United States Patent [19]

Swearingen

[11] Patent Number: 4,502,836

[45] Date of Patent: Mar. 5, 1985

[54] METHOD FOR NOZZLE CLAMPING FORCE CONTROL

[76] Inventor: Judson S. Swearingen, 27403 Pacific Coast Hwy., Malibu, Calif. 90265

[21] Appl. No.: 430,349

[22] Filed: Sep. 30, 1982

Related U.S. Application Data

[63] Continuation-in-part of Ser. No. 394,692, Jul. 2, 1982, abandoned.

[51] Int. Cl.[3] ..... F01D 17/16

[52] U.S. Cl. ..... 415/150; 415/160; 91/44

[58] Field of Search ..... 415/26, 156, 160–164, 415/148, 150, 151, 154, 155; 91/44; 92/27, 28; 60/594; 416/165

[56] References Cited

U.S. PATENT DOCUMENTS

| | | | |
|---|---|---|---|
| 2,341,974 | 2/1944 | Browne | 415/26 |
| 3,141,382 | 7/1964 | Oldfield et al. | 91/44 |
| 3,439,579 | 4/1969 | Guinot | 91/44 |
| 3,495,921 | 2/1970 | Swearingen | 415/163 |
| 4,300,869 | 11/1981 | Swearingen | 415/160 |

*Primary Examiner*—Robert E. Garrett
*Assistant Examiner*—Joseph M. Pitko
*Attorney, Agent, or Firm*—Lyon & Lyon

[57] ABSTRACT

A system for pressurizing cavities arranged laterally of pivotal vanes of a variable primary nozzle system in a radial turbine. The cavities are supplied with fluid of increased or reduced pressure to resist the clamping forces of the mounting rings. The fluid may conveniently be influent pressure or nozzle discharge pressure as may be appropriate. Pressure to the cavities is controlled as responsive to the pressure in the actuator system for adjusting the nozzles.

22 Claims, 4 Drawing Figures

METHOD FOR NOZZLE CLAMPING FORCE CONTROL

RELATED APPLICATION

This application is a continuation in part application of Swearingen, Method and Apparatus for Nozzle Clamping Force Control, Ser. No. 394,692 filed July 2, 1982, now abandoned.

BACKGROUND OF THE INVENTION

The field of the present invention is radial flow turbines and more specifically variable primary nozzle systems in radial flow turbines.

Radial turbines employ an annular inlet surrounding a turbine wheel through which is directed influent under pressure. To uniformly distribute the influent, primary, stationary vanes are disposed about the annular inlet to create nozzles therebetween. These nozzles are often variable through the controlled pivotal motion of the primary vanes.

The primary vanes are typically mounted between mounting rings. One of the mounting rings may be pivotally mounted relative to the other mounting ring which is then employed as a means for pivoting the vanes. The mounting rings are also mounted for relative axial movement therebetween. Normally, one ring is fixed while the other is allowed to move axially to accomplish this result. A pneumatic or hydraulic cylinder is associated with the pivotal mounting ring to forcefully control the position of the ring, in turn controlling the vanes.

Because of the inherent pressures in such radial turbines, particularly the static and dynamic pressures of the flow through the primary nozzles, clamping forces are applied by the mounting rings to the sides of the vanes adjacent the mounting rings if one or both of the rings is axially movable. The close fit of the rings about the vanes prevents leakage flow bypassing the nozzles. However, the resulting clamping forces often can become excessive and actuation of the vanes to adjust the nozzles is inhibited.

Two earlier methods of attempting to control clamping forces are disclosed in U.S. Pat. Nos. 3,495,921 and 4,300,869, both issued to Judson S. Swearingen, the disclosures of which are incorporated herein by reference. In U.S. Pat. No. 3,495,921, a step-cut in the clamping surfaces is employed such that the inlet pressure extends to a point inwardly of the outer extent on the nozzle blades. In this way the static inlet pressure will resist the reduced pressure in the nozzles over a larger area of the mounting rings. In U.S. Pat. No. 4,300,869, cavities are fixed to the sides of the vanes adjacent the mounting rings. These cavities include passages which extend to a source of either vacuum or pressure to affect the axial clamping forces of the rings. In the latter patent, the effect of the cavities largely results from the orientation of the vanes.

SUMMARY OF THE INVENTION

The present invention is directed to the control of clamping forces in primary nozzle systems of radial turbines. Both the method and the apparatus of the present invention are directed to control of clamping forces responsive to the amount of force exerted to reposition the vanes. To this end, pressure in cavities laterally positioned relative to the vanes is selectively controlled to adjust the clamping forces of the mounting rings on the vanes. The selected pressure may be higher than or lower than the pressure creating the clamping force. The selection of higher or lower pressures depends on the location of the cavities relative to the mounting rings. Passages across the nozzles may also be used to equalize pressure and properly position the nozzles between the mounting rings. A pressure source is used to pressurize the cavities which conveniently may be the influent gas if higher pressure is used or to a zone of lower pressure where appropriate. The flow to the cavities is controlled by the force required to drive the actuator system. In the case of a pressure driven actuator system, the pressure may be applied to a valve control mechanism controlling the source of pressure to the cavities.

Accordingly, it is a principal object of the present invention to provide selective control over the clamping forces on a variable nozzle system in a radial turbine. Other and further objects and advantages will become apparent hereinafter.

DETAILED DESCRIPTION OF THE PREFERRED EMBODIMENT

Figure 1:
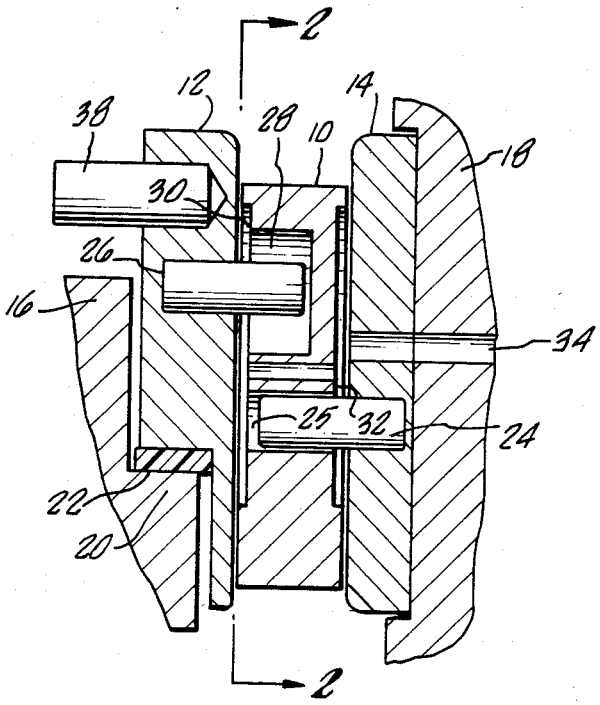
FIG. 1 is a cross-sectional view of a variable nozzle system.

Turning in detail to the drawings, a portion of the variable nozzle arrangement of a radial flow turbine is illustrated. In FIG. 1, the variable primary nozzle system includes a number of pivotally mounted vanes 10 located between mounting rings 12 and 14. The mounting ring 12 is pivotally mounted to the body of the radial turbine 16 while the mounting ring 14 is generally fixed to another portion 18 of the body of the radial turbine. In order that the mounting ring 12 can be moved, a bearing and seal is provided by a shoulder 20 with a polytetrafluouroethylene bushing 22.

To operatively mount the pivotal vanes 10 between the mounting rings 12 and 14, a pin 24 extends from the ring 14 into a hole 25 about which the vane 10 may pivot. A pin 26 extends into the vane 10 from the mounting ring 12 at a position displaced laterally from the first pin 24. This second pin 26 is accommodated in the vane 10 by a slot 28. The slot 28 is angled such that rotation of the mounting ring 12 relative to the mounting ring 14 will result in the pin 26 moving through the slot 28 to rotate the pivotal vane 10 about the first pin 24. In this way, the nozzle cross-sectional area may be varied as the leading portion of each pivotal vane 10 approaches or withdraws from the trailing end of the adjacent vane 10.

One or the other or both of the mounting rings 12 and 14 is mounted such that it can move axially. Thus, relative axial movement between the mounting rings 12 and 14 can occur to result in closure of the spaces between the vanes 10 and the mounting rings 12 and 14. As a result of the sum of all pressures acting on the mounting rings 12 and 14, clamping forces are experienced against the pivotal vanes 10. These clamping forces can become excessive when attempting to adjust the nozzles. Consequently, it is advantageous to moderate the clamping forces, particularly during adjustment of the nozzles.

To resist the clamping forces of the mounting rings 12 and 14 on the pivotal vanes 10, cavities 30 and 32 are positioned on the sides of the vanes adjacent the mounting rings 12 and 14. These cavities 30 and 32 may be sized and located to create specific resisting vectors forcing the mounting rings 12 and 14 to undergo relative axial movement away from the pivotal vanes 10. To pressurize the cavities 30 and 32, a passage 34 extends through the body 18 of the radial turbine and through the mounting ring 14 such that it is in communication with the cavity 32. Conveniently, a second passage 36 exists through the vane 10 itself such that the cavity 30 may be pressurized as well. Thus, flow of pressurized fluid is directed through the passage 34 to the cavity 32 and then from the cavity 32 through the second passage 36 to the cavity 30. Conveniently, the source of pressure directed to passage 34 may be the influent to the radial turbine outwardly of the pivotal vanes 10. Of course, other sources may be used where appropriate or where higher pressures are desired.

Figure 4:
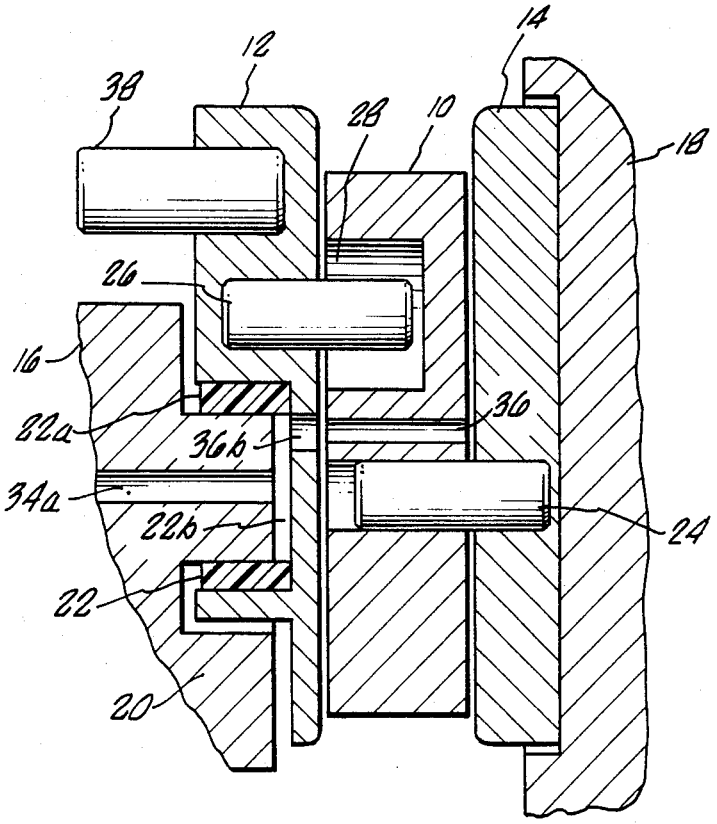
FIG. 4 is a cross-sectional view of a second embodiment of a variable nozzle system.

Another means for resisting or controlling the clamping forces of the mounting rings 12 and 14 on the pivotal vanes 10 is illustrated in FIG. 4. This embodiment is similar to that of FIG. 1 except that there is an additional seal **22*a* which is concentric to the seal 22 and of larger diameter. Between the seals 22 and 22*a* there is an annular space 22*b*. A passage 34*a* is employed for pressure communication with the annular space 22*b*. The passage 34 and the pockets 30 and 32 of the embodiment of FIG. 1 need not be employed in this alternate form. Thus, a pressure cavity is formed on the back side of the mounting ring 12 rather than adjacent the nozzles between the two mounting rings 12 and 14**.

With the arrangement of FIG. 4, pressurization of the annular space **22*b* through the passage 34*a* may be used to regulate the clamping forces on the vanes 10 by the mounting rings 12 and 14. By supplying increased pressure to the cavity 22*b*, the clamping forces would be increased. By pressurizing the cavity 22*b* by means of a zone of lower pressure, the clamping forces are released. The arrangement of FIG. 4 has the advantage of allowing wider limits on area and on radial location of the pressurizable zone 22*b* than for the zones created by cavities 30 and 32 of FIG. 1**.

In controlling the movement of the mounting rings 12 and 14, it may be found that excess release can result. Such excessive parting of the mounting rings 12 and 14 may be prevented by means of a vent port **36*b* which would be uncovered by separation of the clamping ring 12 from the vane 10. This vent port 36*b* would under such circumstances allow pressurized gas from the turbine inlet zone to enter cavity 22*b* through the port 36*b*. As pressure is built up in the cavity 22*b*, the mounting ring 12 would again move toward the vanes and the mounting ring 14. Equilibrium would be established as the vent port 36*b*** is almost closed by such action.

Should the vane 10 follow the clamping ring 12 when the cavity **22*b* is pressurized to a lower pressure, the port 36*b* would not be uncovered. However, a passage 36 extending axially through the vane 10 would be uncovered by such action and would result in communication of pressure to the vent port 36*b*. In turn, the cavity 22*b*** would be pressurized as before.

Figure 3:
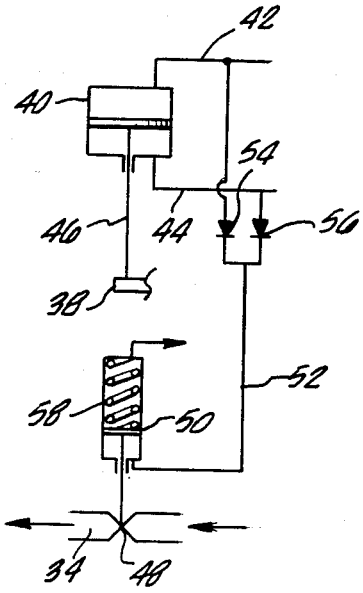
FIG. 3 is a schematic illustration of the control system of the present embodiment.
Figure 2:
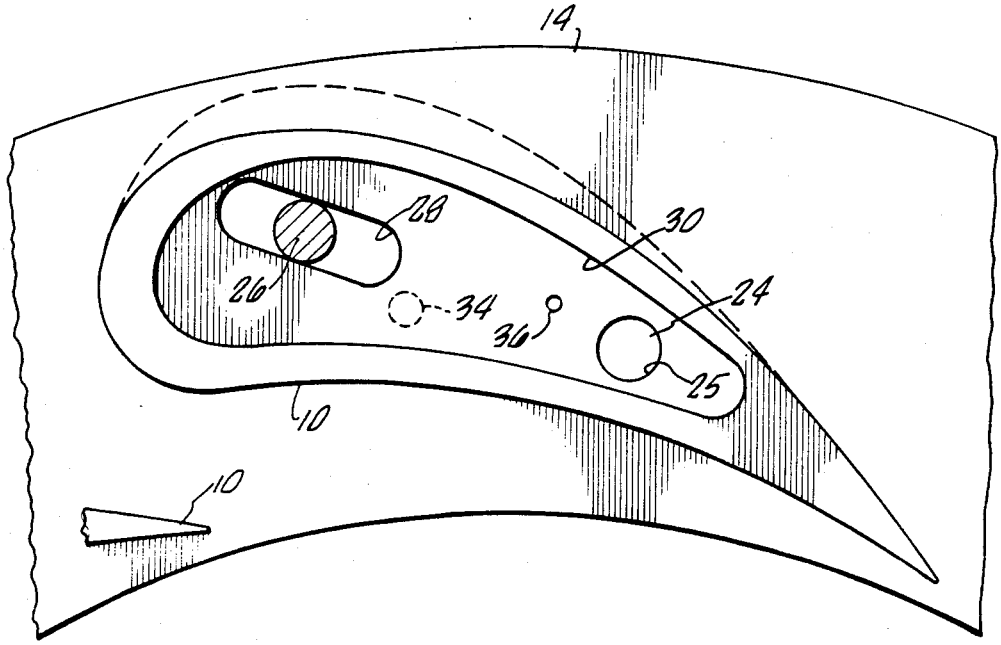
FIG. 2 is a cross-sectional elevation taken along line 2—2 of FIG. 1.

A fluid pressure driven actuator system is schematically illustrated in FIG. 3 for cooperation with the mechanism of FIG. 1. This system is coupled with the mounting ring 12 at a crankpin 38. To create the force for the actuator system to move the mounting ring 12, a fluid cylinder 40 is driven through supply lines 42 and 44. A rod 46 extends to the crankpin 38. Thus, supply pressure directed through line 42 to the cylinder 40 will narrow the nozzles while supply pressure through line 44 will do the opposite.

The actuator system is coupled by means of fluid pressure from the supply lines 42 and 44 to control flow to the cavities 30 and 32. To this end, a pressure actuated valving system is used for controlling flow through the passage 34. This system uses pressure from the actuator system as an indicator of the measured force of the actuator system needed to move the pivotal vanes 10. As pressure builds through supply lines 42 or 44 to force the vanes 10 into the appropriate position, a valve means for controlling flow through the passage 34 is activated at a preselected value. This causes pressure to build in the cavities 30 and 32, reduces the clamping force and thereby reduces the force required to move the vanes 10.

The valve means includes a valve 48 in the passage 34 to control flow from the pressure source to the cavities 30 and 32. A valve control means 50 is used to control the valve 48 and employs a valve actuator driven by pressure from the supply lines 42 and 44. A pressure line 52 extends from the supply lines 42 and 44 and includes two check valves 54 and 56 such that pressure from either line 42 or the line 44 will pressurize the pressure line 52. A spring 58 is employed to resist the pressure from the pressure line 52 such that the valve actuator 50 will not open the valve 48 until a preselected actuator pressure has been achieved. Leakage from the valve actuator 50, represented by the arrow from the top thereof, allows the pressure line to return to a closed state.

The valve 48 or a restriction in the line is preferably employed to reduce the flow even with the valve 48 in the fully open position. The restricted flow is advantageous because it limits the amount of space created between the vanes 10 and the mounting rings 12 and 14 by the pressurized fluid as that fluid is then bled off through the space.

Naturally, as the vanes 10 approach the selected position, the pressure is reduced to the actuator system 40 and the valve 48 closes. At this point, the clamping forces are again unresisted and the mounting rings 12 and 14 tightly grip the vanes 10.

The valve 48 may be employed in a similar manner with the mechanism of FIG. 4. To this end, the valve 48 is coupled with the passage **34*a* to regulate pressure within the cavity 22*b*. In such a use, the passage 34*a* is connected to a source of lower pressure so as to act to draw the mounting ring 12 away from the nozzles 10. Additionally, the valve 48** may be replaced by a three-way valve coupled to a source of pressure such as the inlet pressure and a source of reduced pressure such as the nozzle discharge pressure. With such a device, nozzle clamping forces can be enhanced during steady state flow and reduced during periods when the nozzles are being varied.

Thus, an improved clamping force control is described for the variable nozzles of a radial turbine. While embodiments and applications of this invention have been shown and described, it would be apparent to those skilled in the art that many more modifications are possible without departing from the inventive concepts herein. The invention, therefore, is not to be restricted except in the spirit of the appended claims.

What is claimed is:

1. A method for controlling clamping forces in a variable primary nozzle system of a radial turbine having primary nozzles formed by pivotal nozzle vanes clamped between mounting rings having relative axial movement therebetween, comprising the steps of:

sensing the force required to vary the primary nozzles;

opening a source of pressure when said sensed force exceeds a preselected value;

directing flow from the opened source of pressure to the nozzle vanes adjacent the mounting rings.

2. The method of claim 1 wherein the nozzle system includes a fluid pressure driven actuator system for varying said nozzles and said step of sensing the force includes sensing the pressure applied to the actuator system.

3. The method of claim 2 wherein said step of opening a source of pressure includes directing pressure from the actuator system as applied to vary nozzles to a pressure actuated valving system controlling flow from the source of pressure.

4. The method of claim 1 wherein said step of opening a source of pressure includes restricting the resulting flow to allow a minimum pressure bleed off from between the vanes and the rings.

5. The method of claim 1 wherein said step of directing flow includes receiving flow from the influent to the radial turbine as the source of pressure.

6. A nozzle clamping force control for a variable primary nozzle system on a radial turbine having mounting rings mounted for relative axial movement therebetween, nozzle vanes clamped between the mounting rings, and an actuator for pivoting said nozzle vanes, comprising cavities in the nozzle vane surfaces adjacent the rings;

passages extending to said cavities;

a source of pressure in communication with said passages;

valve means for controlling flow from said source of pressure through said passages;

valve control means for opening said valve means responsive to actuator force.

7. The control of claim 6 wherein said passages extending to said cavities include a first passage extending through a ring to a first said cavity and a second passage extending from said first cavity to a second said cavity.

8. The control of claim 6 wherein said source of pressure is the influent to the radial turbine.

9. A nozzle clamping force control for a variable primary nozzle system on a radial turbine having mounting rings mounted for relative axial movement therebetween, nozzle vanes clamped between the mounting rings and a fluid pressure driven actuator for pivoting said nozzle vanes, comprising cavities in the nozzle vane surfaces adjacent the rings;

passages extending to said cavities;

a source of pressure in communication with said passages;

valve means for controlling flow from said source of pressure through said passages;

a valve actuator operatively coupled with said valve means; and a pressure line from the fluid pressure driven actuator to said valve actuator, said valve actuator being fluid pressure actuated and having a preselected actuation pressure.

10. A method for controlling clamping forces in a variable primary nozzle system of a radial turbine having primary nozzles formed by pivotal nozzle vanes clamped between mounting rings having relative axial movement therebetween, comprising the steps of:

sensing the force required to vary the primary nozzles;

opening a source of pressure when said sensed force exceeds a preselected value;

directing pressure from the opened source of pressure to at least one cavity laterally positioned to the nozzle vanes.

11. The method of claim 10 wherein the nozzle system includes a fluid pressure driven actuator system for varying said nozzles and said step of sensing the force includes sensing the pressure applied to the actuator system.

12. The method of claim 11 wherein said step of opening a source of pressure includes directing pressure from the actuator system as applied to vary nozzles to a pressure actuated valving system controlling flow from the source of pressure.

13. The method of claim 10 wherein said step of directing pressure includes receiving pressure from the influent to the radial turbine as the source of pressure.

14. The method of claim 10 wherein said step of directing flow includes receiving reduced pressure from the nozzle discharge area of the turbine as the source of pressure.

15. A nozzle clamping force control for a variable primary nozzle system on a radial turbine having mounting rings mounted for relative axial movement therebetween, nozzle vanes clamped between the mounting rings, and an actuator for pivoting said nozzle vanes, comprising at least one cavity laterally positioned to the nozzle vanes;

a passage extending to said cavity;

a source of pressure in communication with said passage;

valve means for controlling pressure from said source of pressure through said passage;

valve control means for opening said valve means responsive to actuator force.

16. The control of claim 15 wherein said cavity is on an opposite side of one of the mounting rings to the nozzle vanes.

17. The control of claim 16 further including a vent port extending through the clamping ring from the cavity to adjacent at least one nozzle vane.

18. The control of claim 17 further including a passageway through at least one nozzle vane in alignment with said vent port.

19. The control of claim 16, 17 or 18 wherein said source of pressure is an area of reduced pressure in the turbine.

20. The control of claim 19 wherein said area of reduced pressure is the nozzle discharge.

21. The control of claim 15 wherein said source of pressure is the influent to the radial turbine.

22. A nozzle clamping force control for a variable primary nozzle system on a radial turbine having mounting rings mounted for relative axial movement therebetween, nozzle vanes clamped between the mounting rings and a fluid pressure driven actuator for pivoting said nozzle vanes, comprising a cavity laterally positioned adjacent a mounting ring on a side opposite from the nozzle vanes;

a passage extending to said cavity;

a source of pressure in communication with said passage;

a valve means for controlling flow from said source of pressure through said passage;

a valve actuator operatively coupled with said valve means; and a pressure line from the fluid pressure driven actuator to said valve actuator, said valve actuator being fluid pressure actuated and having a preselected actuation pressure.

* * * * *